United States Patent [19]

McQueen et al.

[11] Patent Number: 4,637,446

[45] Date of Patent: Jan. 20, 1987

[54] BUILDING AND BI-FOLD DOOR ASSEMBLY

[75] Inventors: Coy E. McQueen; Lynn O. Twedt, both of Harvard, Ill.; Edwin H. Thurnau, Delavan, Wis.

[73] Assignee: Erect-A-Tube, Inc., Harvard, Ill.

[21] Appl. No.: 678,582

[22] Filed: Dec. 5, 1984

[51] Int. Cl.[4] ..... E05D 15/26

[52] U.S. Cl. ..... 160/207; 160/213

[58] Field of Search ..... 160/207, 201, 206, 210, 160/213, 203, 88; 52/73, 90

[56] References Cited

U.S. PATENT DOCUMENTS

| | | | |
|---|---|---|---|
| 1,782,203 | 11/1930 | Hanley | 160/229 R |
| 1,927,294 | 9/1933 | Perrigo | 160/207 |
| 2,041,410 | 5/1936 | Goodman | 160/207 |
| 2,069,966 | 2/1937 | Morgan | 160/213 X |
| 2,155,116 | 4/1939 | Cox | 160/207 |
| 2,238,181 | 4/1941 | Morgan | 160/213 X |
| 2,327,316 | 8/1943 | Michelman | 160/189 |
| 2,681,699 | 6/1954 | Lissaman | 160/190 |
| 3,024,838 | 3/1962 | Egleston et al. | 160/193 |
| 3,034,607 | 5/1962 | Haines, Jr. | 189/1.5 |
| 3,074,518 | 1/1963 | Conrad et al. | 189/1.5 |
| 3,155,147 | 11/1964 | Smith | 160/189 |
| 3,504,729 | 4/1970 | Alton | 160/207 X |
| 3,550,333 | 12/1970 | Kliewer et al. | 52/73 |
| 3,563,578 | 2/1971 | Meller | 287/20.924 |
| 3,648,755 | 3/1972 | Thiele | 160/201 |
| 3,658,114 | 4/1972 | Buehler | 160/207 |
| 3,673,749 | 7/1972 | Allen | 52/73 |
| 3,797,179 | 3/1974 | Jackson | 52/90 |
| 3,818,652 | 6/1974 | Pierce | 52/23 |
| 3,823,519 | 7/1974 | Cordova | 52/65 |
| 3,838,879 | 10/1974 | Lilly | 296/1 R |
| 3,875,710 | 4/1975 | Dawson et al. | 52/236 |
| 4,124,055 | 11/1978 | Aspenson et al. | 160/213 |
| 4,177,854 | 12/1979 | DeVore | 160/207 |
| 4,261,409 | 4/1981 | DeVore | 160/207 |
| 4,448,232 | 5/1984 | McQueen et al. | 160/207 |
| 4,545,418 | 10/1985 | List et al. | 160/207 X |

OTHER PUBLICATIONS

Port-O-Port brochure entitled "Executive II Portable Aircraft Hangar for Cabin Class Twins" (1979) (2 pages).

Morgan brochure entitled "Morgan Modufold Portable Widespan Steel Buildings" (no date) (4 pages).

Erect-A-Tube, Inc. brochure entitled "Erect-A-Tube, Inc. Hangar Doors" (no date) (4 pages).

List Continued on next page.

*Primary Examiner*—Ramon S. Britts

*Assistant Examiner*—David M. Purol

*Attorney, Agent, or Firm*—Wood, Dalton, Phillips, Mason & Rowe

[57] ABSTRACT

A building including an upper wall portion and a lower wall portion and a bi-fold door assembly mounted within an opening therein. The wall portions have front surfaces facing outwardly of the building and the upper wall portion is disposed in a plane intersecting the plane defined by the lower wall portion. The upper wall portion is sloped downwardly and outwardly of the top thereof to a position overlying the lower wall portion and the plane defined by the lower wall portion is a generally vertical plane with the top of the upper wall portion being disposed in or near the generally vertical plane. The bi-fold door assembly is movable between raised and lowered positions within the opening in the wall portions and includes an upper door section and a lower door section. The upper door section is hinged to the lower door section with the door sections having front surfaces facing outwardly of the building and rear surfaces facing inwardly of the building. The upper door section is disposed in a plane intersecting the plane defined by the lower door section in the lowered position of the door assembly. The upper door section is sloped downwardly and outwardly of the top thereof to a position overlying the lower door section in the lowered position of the door and the plane defined by the lower door section is a generally vertical plane with the top of the upper door section being disposed in or near the generally vertical plane in the lowered position of the door assembly. Additionally, the upper wall portion and upper door section are coplanar and the lower wall portion and lower door section are coplanar in the lowered position of the door assembly.

38 Claims, 12 Drawing Figures

OTHER PUBLICATIONS

Erect-A-Tube, Inc. brochure entitled "When Dollars Count!" (no date) (1 page).

Erect-A-Tube, Inc. brochure entitled "Erect-A-Tube, Inc. Electric Bi-Fold Hangar Doors" (no date) (2 pages).

Erect-A-Tube, Inc. brochure entitled "Erect-A-Tube, Inc. Bi-Fold Doors" (no date) (4 pages).

Erect-A-Tube, Inc. brochure entitled "Erect-A-Tube, Inc. Aircraft Hangars (1968) (4 pages).

Erect-A-Tube, Inc. product data sheet entitled "Erect-A-Tube, Inc. Unmatched Versitility in Tee Hangar Planning" (no date) (1 page).

Erect-A-Tube, Inc. brochure entitled "Erect-A-Tube, Inc. Electric Bi-Fold Doors for Farms, Shops and Hangars" (no date) (2 pages).

Schweiss Automatic Bi-Fold Doors literature entitled "The New Schweiss Automatic Bi-Fold Door!" (no date) (one page).

Schweiss Automatic Bi-Fold Doors literature entitled "The Mini Bi-Fold" (no date) (one page).

Erect-A-Tube, Inc. drawing No. E-3423-1 entitled "Door Layout—Vander-Kodde Construction" (8/28/80) (one page).

BUILDING AND BI-FOLD DOOR ASSEMBLY

BACKGROUND OF THE INVENTION

The present invention relates to a building and a door assembly mounted therein and, more particularly, to a building and a bi-fold door assembly coplanar with the walls thereof.

In recent years, the use of out buildings for storage has expanded to a very significant degree. Such buildings have found use, for instance, as hangars to accommodate the considerable expansion in the use of small aircraft for both business and pleasure with the resulting problem of providing adequate shelter at a reasonable price and for storage of large equipment such as farm machinery, earth moving equipment, large trucks and the like. As a result, the need for buildings having large doors which operate safely, effectively and efficiently has been the focus of those in this field.

Some years ago, Erect-A-Tube, Inc., our assignee, pioneered the development of a unique bi-fold door. These doors, which are quite large in size ranging to at least 80 feet wide 20 feet high, have become standard. It is now recognized that the bi-fold door gives rugged, dependable service and is reliable and easy working in almost every climatic condition. These doors, which are easy to install on post-frame or steel buildings, can be sheeted and insulated with conventional building materials. As such, the bi-fold doors give extra clearance for large openings and are compatible with all metal building systems.

In the past, bi-fold doors have been constructed so that the upper and lower door sections are coplanar. The door, which usually includes two co-planar door sections which are horizontally hinged, generally includes means on the bottom of the lower door portion to cooperate with a door track. As a result, the bottom of the door moves straight up from the floor to minimize the effect of snow and ice on the opening action.

Despite the numerous significant advantages to a bi-fold door, several problems have remained unresolved. One problem has been that snow and ice can sometimes build up at the base of the door to restrict the opening action and/or make it necessary for snow removal to eliminate frozen door problems. In particular, where there is frequent thawing and freezing, ice can build up at the bottom of the door thereby causing the door to stick in the down position.

When this occurs, it is oftentimes very difficult to remove the ice. It has also been the case that, when there is a buildup of snow at the bottom of the door, drivers of snow plows at airports and the like have damaged such doors by attempting to clear the snow without manual labor. Further, since metal building systems usually do not have gutters and down spouts, it is difficult to keep water from passing under the door.

Still another problem with bi-fold doors has been the difficulty in assuring that the door fully closes when it is lowered. This is absolutely essential to provide the requisite security as well as to fully protect the contents of the building from weather conditions. Because of the fact that vertical door tracks are the norm in such buildings, and the uniqueness of the configuration of the door, the bi-fold door can have a tendancy to stick in a partially opened condition.

Accordingly, it has remained to provide a building and a bi-fold door that overcomes the problems outlined.

SUMMARY OF THE INVENTION

In general, the present invention is directed to a building and a bi-fold door assembly with a unique combination of features and components. The building includes an upper wall portion and a lower wall portion both of which have front surfaces adapted to face outwardly of the building together with an opening for a door assembly therein. The upper wall portion is disposed in a plane intersecting the plane defined by the lower wall portion. The plane defined by the lower wall portion is a generally vertical plane and the top of the upper wall portion is disposed in or near the generally vertical plane. The upper wall portion is sloped downwardly and outwardly of the top thereof to a position overlying the lower wall portion. A bi-fold door assembly movable between raised and lowered positions is mounted within the opening in the wall portions and includes an upper door section and a lower door section. The upper door section is hinged to the lower door section both of which have front surfaces facing outwardly of the building together with rear surfaces facing inwardly thereof. The upper door section is disposed in a plane intersecting the plane defined by the lower door section in the lowered position of the door assembly. The plane defined by the lower door section is a generally vertical plane and the top of the upper door section is disposed in or near the generally vertical plane in the lowerd position of the door assembly. The upper door section is sloped downwardly and outwardly of the top thereof to a position overlying the lower door section in the lowered position of the door assembly. With this arrangement, the upper wall portion and upper door section are coplanar and the lower wall portion and lower door section are coplanar in the lowered position of the door assembly.

In a preferred embodiment, the bi-fold door includes a door track adapted to be mounted adjacent the inwardly facing rear surface of the lower door section and inwardly of the inwardly facing rear surface of the upper door section. It will also be appreciated that the bi-fold door will include means associated with the bottom of the lower door section adapted to cooperate with the door track, and the top of the upper door section is adapted to be hinged for pivotable movement above the top of the door track in a direction opposite the direction of pivotable movement of the lower door section. Moreover, the top of the upper door section and the bottom of the lower door section always remain in the generally vertical plane defined by the door track.

Additional features of the present invention include an independent frame assembly associated with each of the upper and lower door sections. The frame assembly associated with the upper door section is hinged to the frame assembly associated with the lower door section and both are covered with a sheeting material with the frame assembly associated with the upper door section including a rectangular frame disposed in a generally vertical plane and a frame portion projecting outwardly of the rectangular frame at or near the bottom thereof in a generally horizontal plane. With this construction, the sheeting material covers the upper door section from the top of the rectangular frame to the outermost point of the outwardly projecting frame portion.

In the preferred embodiment, a latch assembly including a spring biased latch member mounted for pivotal movement on the lower door section and a catch plate mounted on the door track is provided. The latch member is adapted to engage the catch plate to lock the door assembly in the lowered position, and the latch assembly also includes a stop member to limit pivotal movement of the latch member together with means for pivotally moving the latch member into contact with the stop member in which position it is disengaged from the catch plate to permit movement of the door assembly to the raised position. In particular, the means for pivotally moving the latch member includes a lift cable adapted to disengage the latch member from the catch plate against the biasing force of a spring on the latch member when the lift cable is subjected to a lifting force to raise the door.

Still other objects, features and advantages of the present invention will become apparent from the following description when considered in connection with the accompanying drawings.

DETAILED DESCRIPTION OF THE PREFERRED EMBODIMENTS

Figures 1, 2:
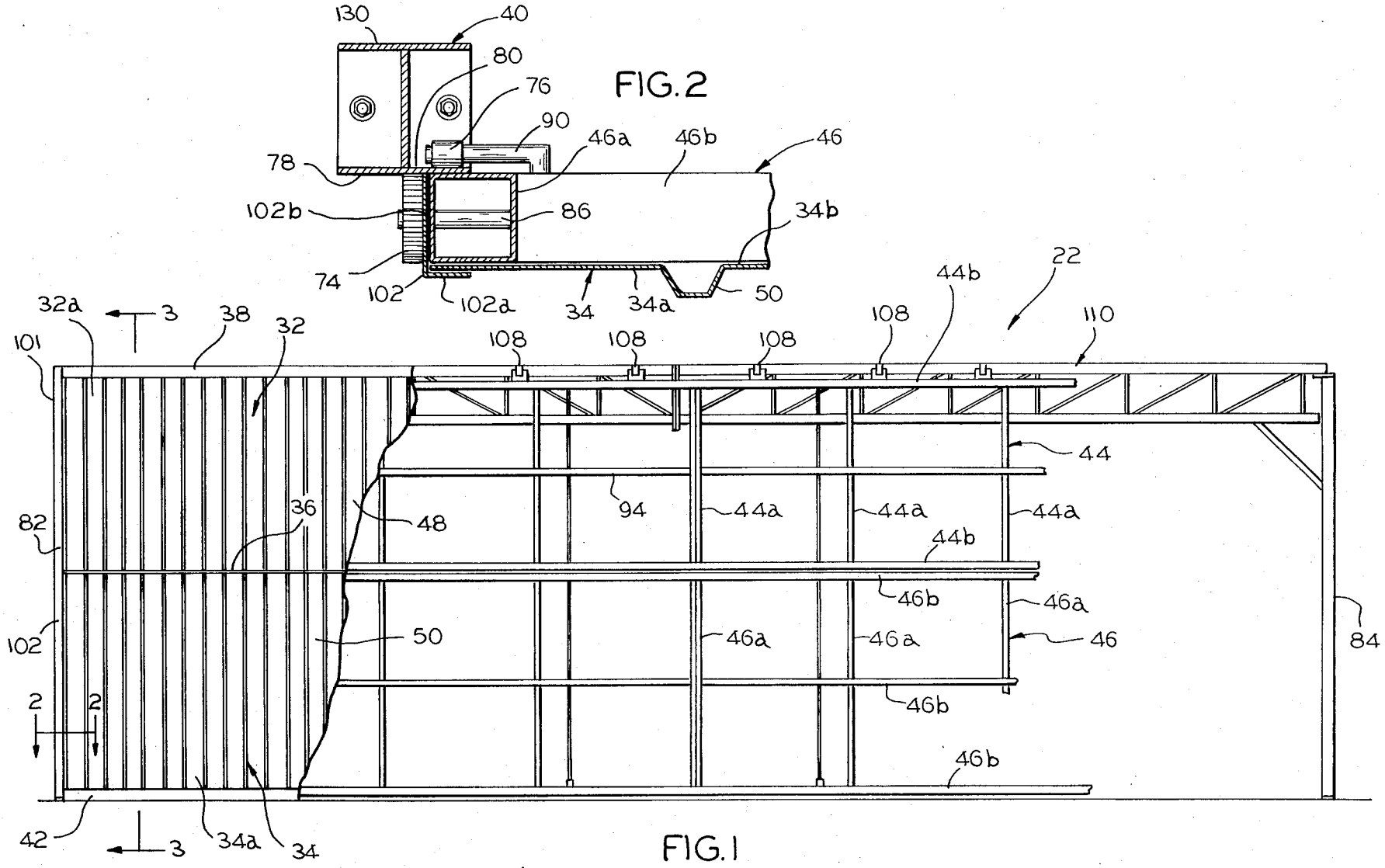
FIG. 1 is a front elevational view of a bi-fold door assembly in accordance with the present invention.
FIG. 2 is a cross-sectional view of the bi-fold door assembly taken on the line 2—2 in FIG. 1.
Figure 11:
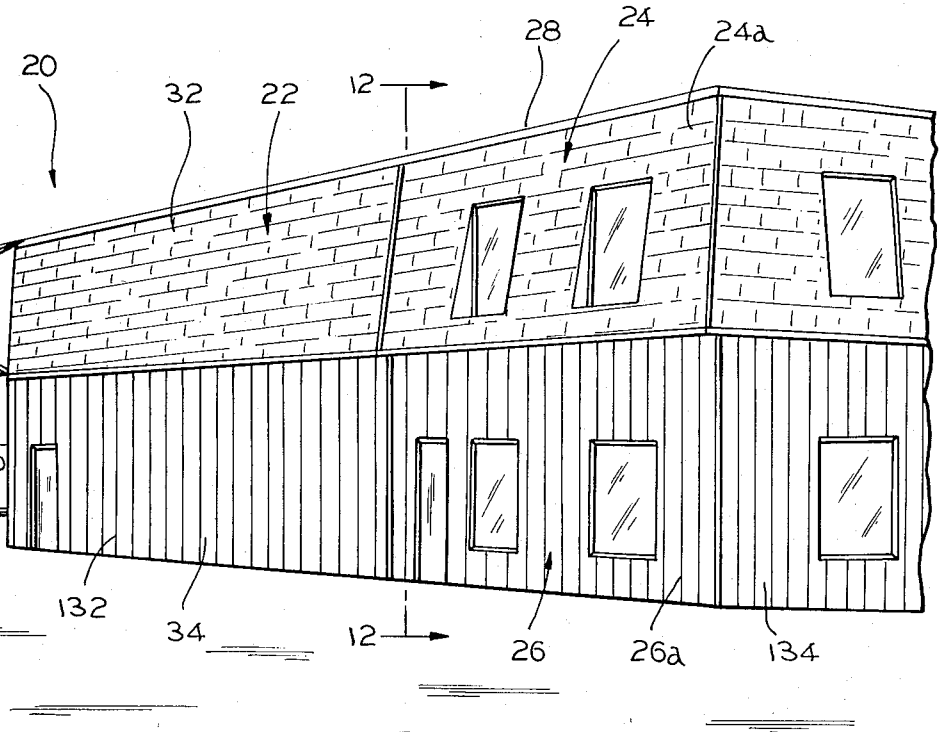
FIG. 11 is a perspective view of a building having a bi-fold door assembly mounted therein.
Figure 12:
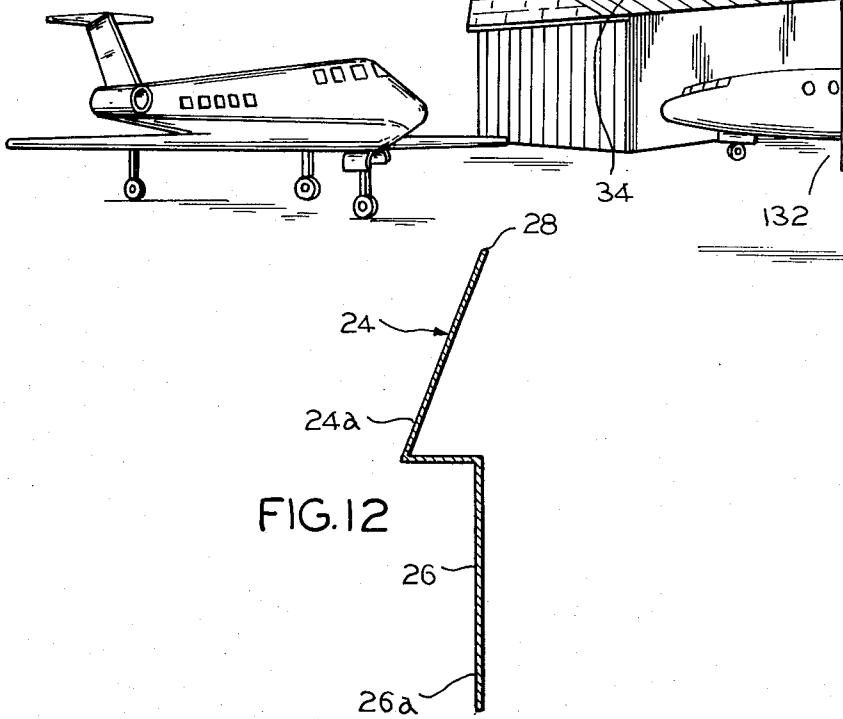
FIG. 12 is a cross-sectional view of the building taken on the line 12—12 in FIG. 11.

In the illustrations given, and first with reference to FIGS. 1 and 11, the reference numeral 20 designates a building and a bi-fold door assembly 22 with a unique combination of features and components. The building 20 includes an upper wall portion 24 and a lower wall portion 26 both of which have outwardly facing front surfaces 24*a* and 26*a*, respectively. The outwardly facing front surface 24*a* of the upper wall portion 24 is disposed in a plane intersecting the plane defined by the outwardly facing front surface 26*a* of the lower wall portion 26 (see FIG. 12). The plane defined by the outwardly facing front surface 26*a* of the lower wall portion 26 is a generally vertical plane and the top 28 of the upper wall portion 24 is disposed in or near the generally vertical plane (see FIG. 12). The building 20 also is constructed with the outwardly facing front surface 24*a* of the upper wall portion 24 sloped downwardly and outwardly of the top 28 to a position overlying the outwardly facing front surface 26*a* of the lower wall portion 26. In addition, as shown in FIG. 11, the bi-fold door assembly 22 is mounted within an opening 30 in the upper and lower wall portions 24 and and is movable between raised and lowered positions as will be described in detail hereinafter.

Figure 3:
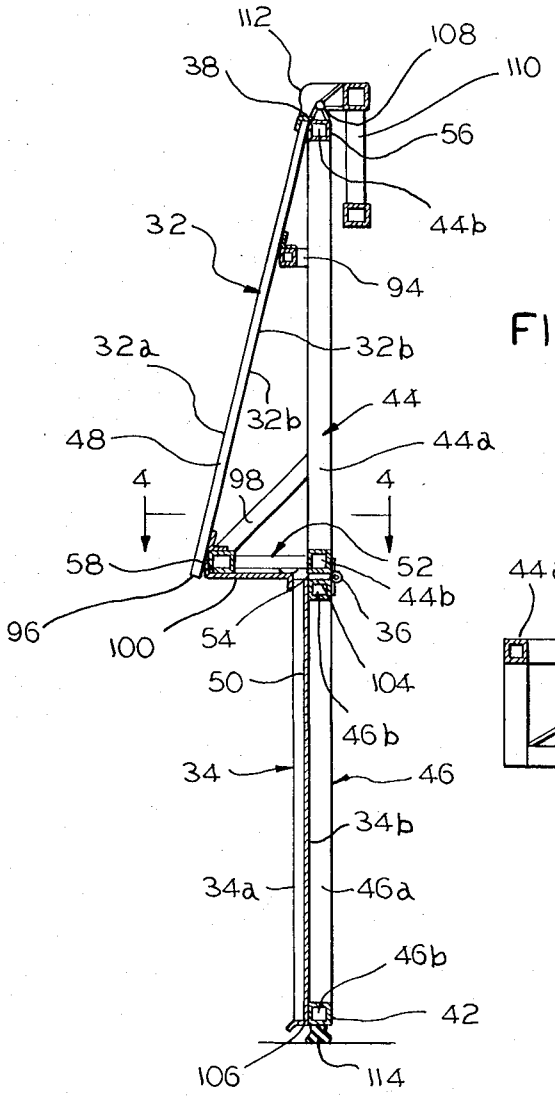
FIG. 3 is a cross-sectional view of the bi-fold assembly taken on the line 3—3 in FIG. 1.

Referring to FIG. 3, the bi-fold door assembly 22 includes an upper door section 32 and a lower door section 34. The upper door section 32 is hinged as at 36 to the lower door section 34 both of which have front surfaces 32*a* and 34*a*, respectively, facing outwardly of the building 20 together with rear surfaces 32*b* and 34*b* respectively, facing inwardly thereof. The outwardly facing front surface 32*a* of the upper door section 32 is disposed in a plane intersecting the plane defined by the outwardly facing front surface 34*a* of the lower door section 34 in the lowered position of the door assembly 22. The plane defined by the outwardly facing front surface 34*a* of the lower door section 34 is a generally vertical plane and the top 38 of the upper door section 32 is disposed in or near the generally vertical plane in the lowered position of the door assembly 22. The upper door section 32 is constructed with the outwardly facing front surface 32*a* sloped downwardly and outwardly of the top 38 to a position overlying the outwardly facing front surface 34*a* of the lower door section 34. With this arrangement, the upper wall portion 24 and upper door section 32 are coplanar and the lower wall portion 26 and lower door section 34 are coplanar in the lowered position of the door assembly 22.

Figure 5:
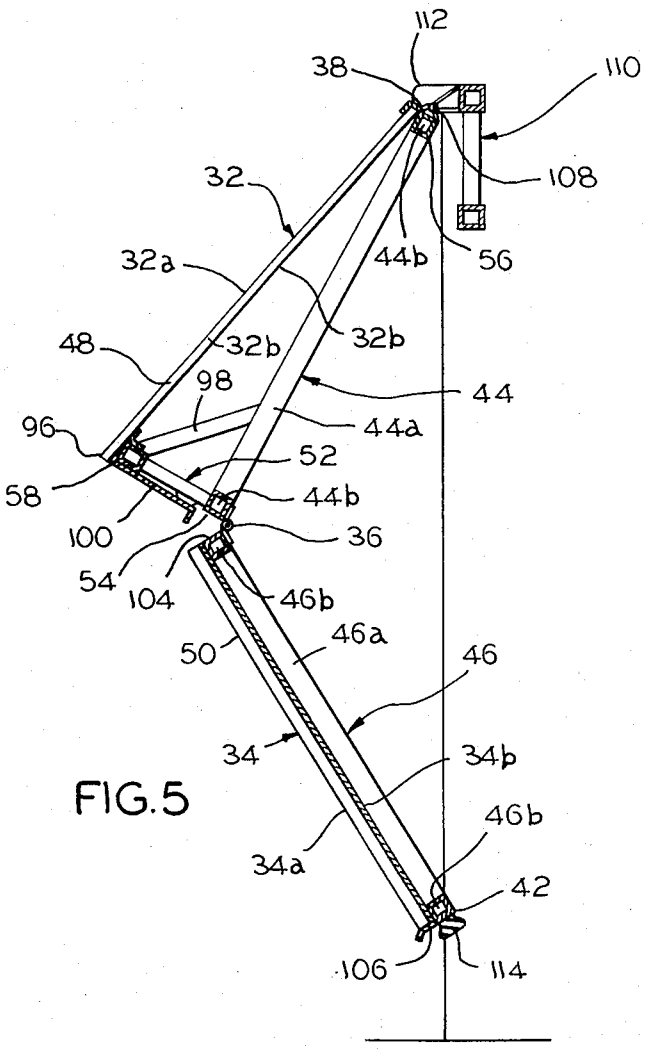
FIG. 5 is a cross-sectional view of the bi-fold door assembly in a partially raised position.
Figure 6:
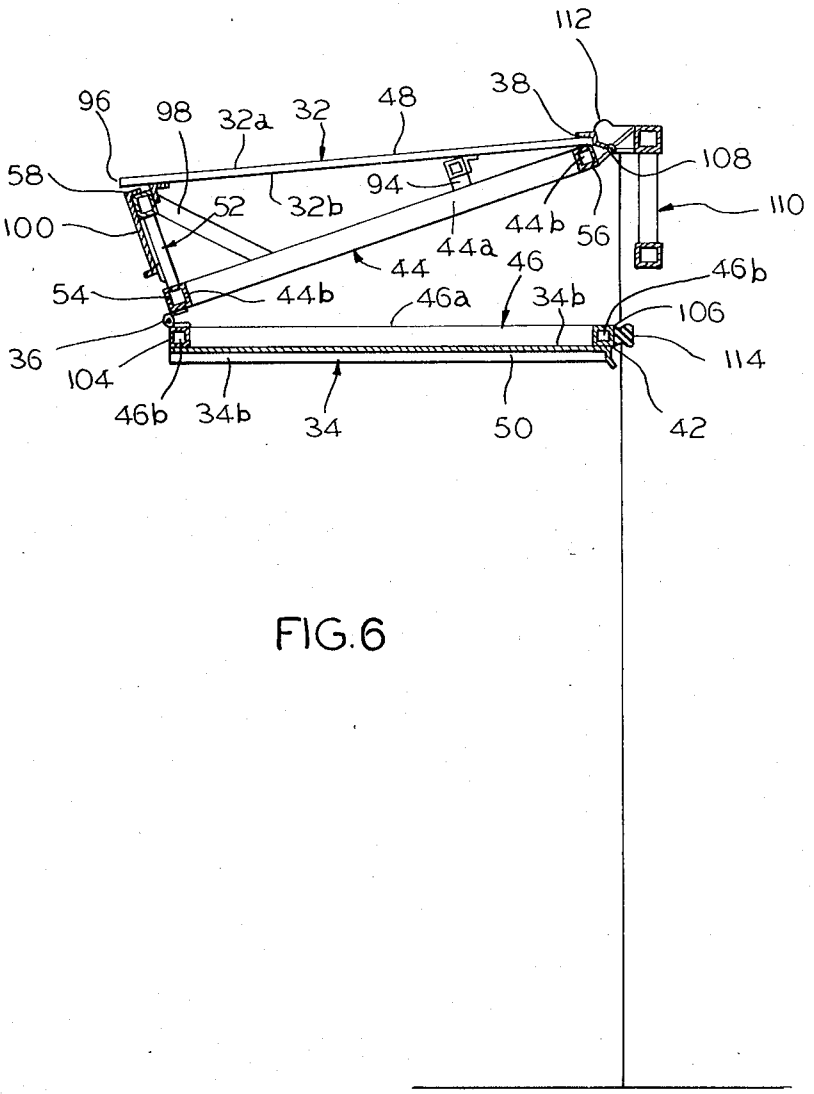
FIG. 6 is a cross-sectional view of the bi-fold door assembly in a fully raised position.

Referring to FIG. 2, the bi-fold door assembly 22 includes a door track 40 adapted to be mounted adjacent the inwardly facing rear surface 34*b* of the lower door section 34 and inwardly of the inwardly facing rear surface 32*b* of the upper door section 32. It will also be seen that the bi-fold door assembly includes means associated with the bottom 42 of the lower door section 34 adapted to cooperate with the door track 40, as will be described in detail hereinafter, and the top 38 of the upper door section 32 is adapted to be hinged for pivotable movement above the top of the door track 40 in a direction opposite the direction of pivotable movement of the lower door section 34. Additionally, as shown in FIGS. 3, 5 and 6, the top 38 of the upper door section 32 and the bottom 42 of the lower door section 34 always remain in the generally vertical plane defined by the door track 40.

Referring to FIGS. 1 and 3, the bi-fold door assembly 22 includes independent rectangular frame assemblies 44 and 46 associated with the respective upper and lower door sections 32 and 34. The frame assembly 44 associated with the upper door section 32 is hinged to the frame assembly 46 associated with the lower door section 34 as at 36 and both are covered with a sheeting material 48 and 50, respectively, with the frame assembly 44 including a generally rectangular frame portion 52 at or near the bottom 54 thereof projecting outwardly in a generally horizontal plane (see FIGS. 3 and 4). With this construction, the sheeting material 48 covers the upper door section 32 from the top 56 of the frame assembly 44 to the outermost point 58 of the outwardly projecting frame portion 52 to comprise the downwardly and outwardly sloped front surface 32*a* thereof.

Figure 8:
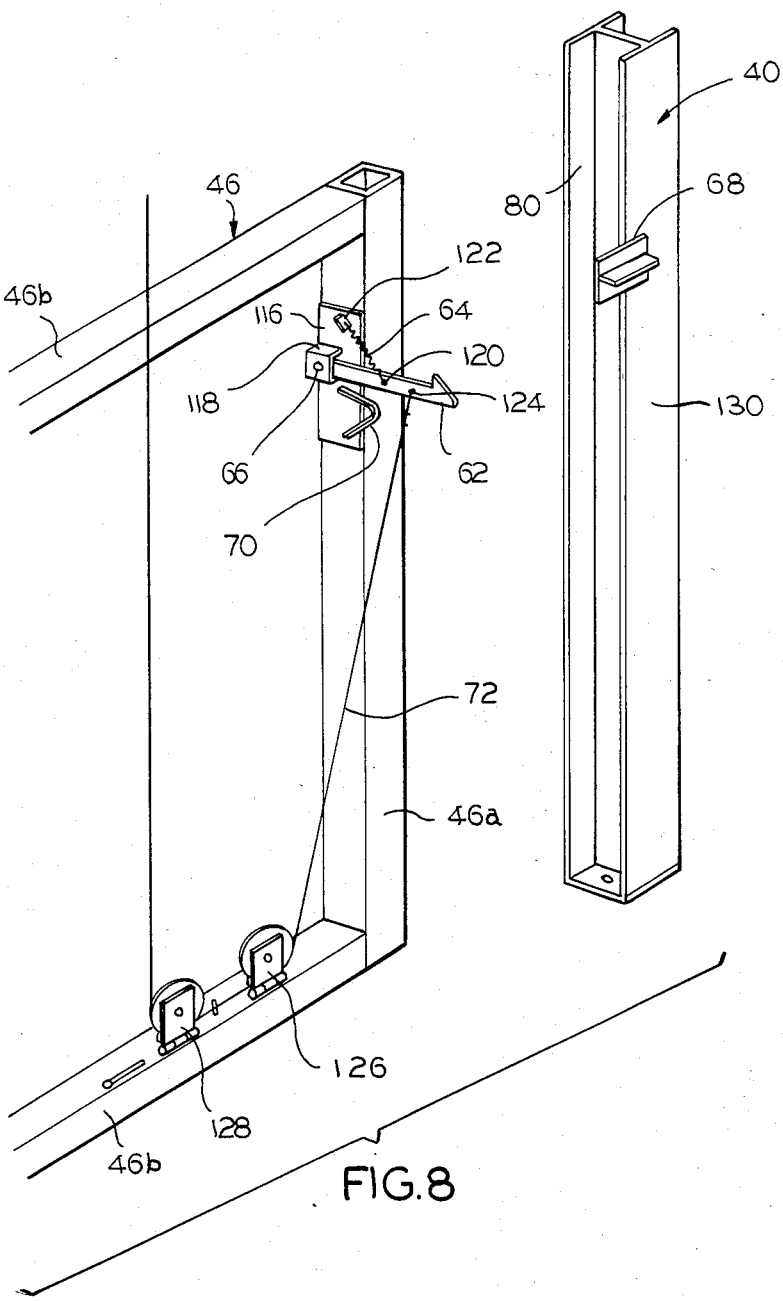
FIG. 8 is a perspective view illustrating a latch assembly for a bi-fold door assembly.
Figure 9:
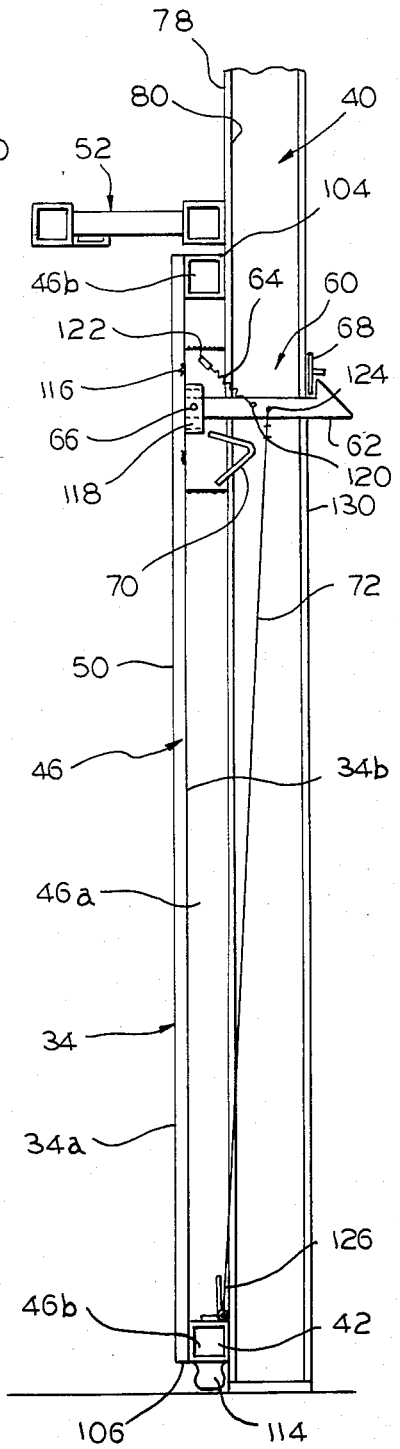
FIG. 9 is a cross-sectional view illustrating the latch assembly of FIG. 8.

Referring to FIGS. 8 and 9, a latch assembly 60 including a latch member 62 biased by means of a spring 64 is provided. The latch member 62 is mounted for pivotal movement as at 66 on the frame assembly 46 of the lower door section 34 and a catch plate 68 is mounted on the door track 40 such that the latch member 62 is adapted to engage the catch plate 68 to lock the door assembly 22 in the lowered position of the door assembly 22, and the latch assembly 60 also includes a stop member 70 to limit pivotal movement of the latch member 62 together with means for pivotally moving the latch member 62 into contact with the stop member 70 in which position it is disengaged from the catch plate 68 to permit movement of the door assembly 22 to the raised position. In particular, the means for pivotally moving the latch member 62 includes a lift cable 72 adapted to disengage the latch member 62 from the catch plate 68 against the biasing force of the spring 64 on the latch member 62 when the lift cable 72 is subjected to a lifting force to raise the door 22.

Referring once again to FIG. 2, the means adapted to cooperate with the door track 40 comprises a guide roller 74 and a column follower 76 both of which are mounted at the bottom of the frame assembly 46 of the lower door section 34 for engagement with the door track 40 for movement therealong. The door track 40 is preferably formed of steel angle (as shown) having an outwardly facing front surface 78 adapted to confront the inwardly facing rear surface **34*b* of the lower door section 34, and the guide roller 74 rolls along the outwardly facing front surface 78 of the steel angle 40 with the column follower 76 in engagement with the oppositely facing surface 80 thereof. In addition, as will be appreciated, the door track is in the form of a straight H-shaped section adapted to be mounted adjacent each of the opposing ends 82 and 84 of the door assembly 22 and a guide roller 74 and column follower 76 is provided at the bottom 42 of the lower door section 34 at opposite ends to cooperate with each of the door tracks 40**.

As shown in FIG. 2, the guide roller 74 is mounted on a pin 86 extending through a tubular frame member **46*a*. The tubular frame member 46*a* comprises a portion of the frame assembly 46 and is adapted to rest against the outwardly facing surface 78 of the door track 40 in the lowered position of the door assembly 22. Moreover, the column follower 76 is mounted on an L-shaped arm 90 secured to a generally horizontal tubular frame member 46*b* at the bottom 42 of the lower door section 34**.

Referring to FIGS. 1 and 3, the frame assembly 44 associated with the upper door section 32 includes a structural support member 94 projecting outwardly intermediate the top 56 and bottom 54 thereof. The structural support member 94 extends between the frame assembly 44 and the sheeting material 48, and stiffens the sheeting material 48 intermediate the top 38 and bottom 96 thereof. In the embodiment illustrated in FIGS. 1 and 3, the structural support member 94 is formed of tubular steel, and the frame assemblies 44 and 46 are also formed of tubular steel.

Figure 4:
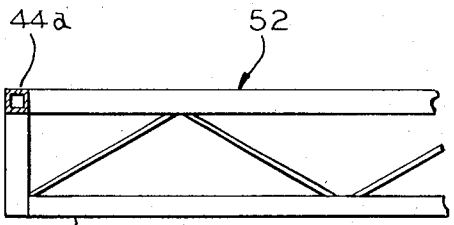
FIG. 4 is a cross-sectional view of the bi-fold door assembly taken on the line 4—4 in FIG. 3.

Referring to FIGS. 3 and 4, the frame portion 52 projecting outwardly of the frame assembly 44 is a rectangular truss. The rectangular truss 52, which is preferably horizontally disposed, is also disposed perpendicular to the frame assembly 44, and a structural brace member 98 is provided which extends from the outermost point 58 of the rectangular truss 52 to a point intermediate the top and bottom 56 and 54 of the frame assembly 44. While a plurality of structural brace members 98 will be provided depending on the length of the door assembly 22, it will be appreciated that each structural brace member 98 will be secured to both the rectangular truss 52 and the frame assembly 44 in rigid fashion as by welding or the like.

Figure 7:
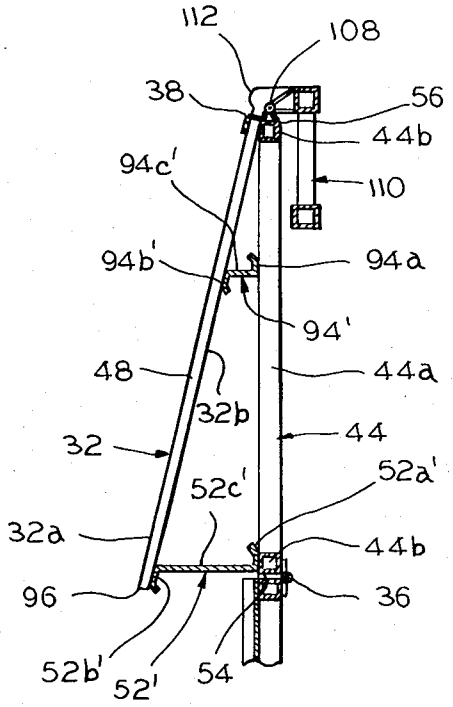
FIG. 7 is a cross-sectional view of an alternative embodiment in accordance with the present invention.

Referring to FIG. 7, the outwardly projecting frame portion 52' of the frame assembly 44 is a horizontally disposed Z-shaped member. The Z-shaped member 52' is disposed perpendicular to the frame assembly 44 and the sheeting material 48 is secured to the frame assembly 44 and the horizontally disposed Z-shaped member 52'. The Z-shaped member 52' is secured to the frame assembly 44 at the bottom 54 and includes an upwardly projecting flange **52*a'* and a downwardly projecting flange 52*b'*. As will be appreciated, the upwardly projecting flange 52*a'* is adapted to be secured to one of the frame assembly 44 and sheeting material 48 with the downwardly projecting flange 52*b'* being adapted to be secured to the other of the frame assembly 44 and sheeting material 48, and the Z-shaped member 52' includes a solid web portion 52*c'* joining the flanges 52*a'* and 52*b'***.

With regard to the embodiment illustrated in FIG. 7, the solid web portion **52*c'* functions as a soffit sheet covering the space between the bottom 96 of the sheet member 48 and the bottom 54 of the frame assembly 44. The embodiment illustrated in FIGS. 3 through 6, on the other hand, is provided with a separate soffit sheet 100 secured to the rectangular truss 52 which extends from the sheeting material 48 covering the upper door section 32 to the sheeting material 50 covering the lower door section 34. As shown, the soffit sheet 100 is disposed in a generally horizontal plane in the fully lowered position of the door assembly 22**.

Figure 10:
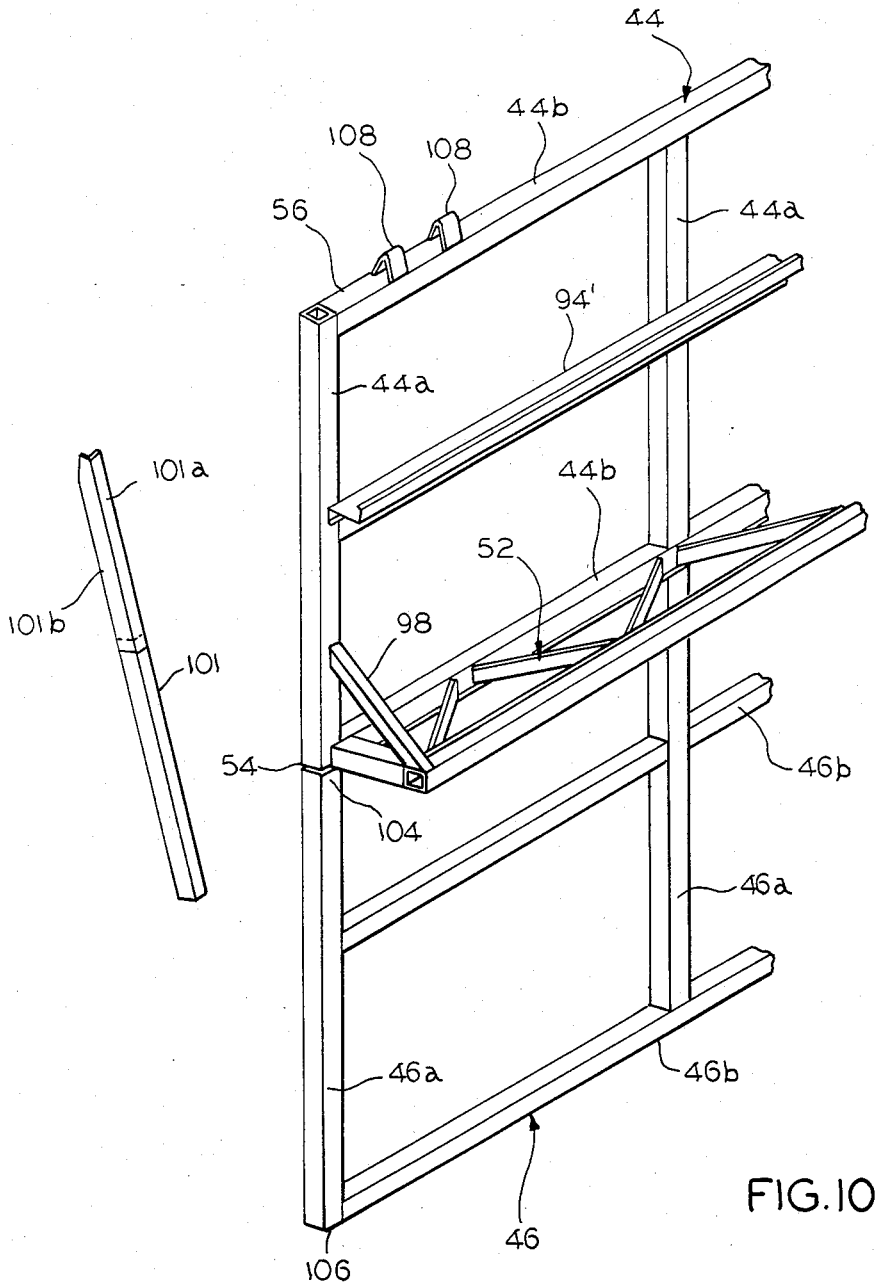
FIG. 10 is a perspective view illustrating a frame assembly for a bi-fold door assembly.

As will be appreciated by referring to FIGS. 1, 2 and 10, a pair of end caps 101 and 102 are associated with each of the upper and lower door sections 32 and 34, respectively. The end caps 101 associated with the upper door section 32 extend from the top 56 of the frame assembly 44 to the outermost point 58 of the frame portion 52 and each includes a first flange **101*a* overlapping the sheeting material 48 thereon and a second flange 101*b* perpendicular to the first flange 101*a* and projecting inwardly thereof to overlap a generally triangular piece of sheeting material (not shown) covering the ends of the upper door section 32. The end caps 102 associated with the lower door section 34 extend from the top 104 of the rectangular frame 46 to the bottom 106 of the rectangular frame 46 and include a first flange 102*a* overlapping the sheeting material 50 and a second flange 102*b* perpendicular to the first flange 102*a* and projecting inwardly thereof. As will be appreciated by referring to the drawings, the end caps 101 and 102 are generally L-shaped in configuration and present a finished appearance for the door assembly 22**.

Referring to FIG. 1, the independent frame assemblies 44 and 46 can be formed of a plurality of vertical tubular steel frame members **44*a* and 46*a*, respectively, and a plurality of horizontal tubular steel frame members 44*b* and 46*b*, respectively. The exact number and arrangement of the vertical members 44*a* and 46*a* and horizontal members 44*b* and 46*b*, as well as the location and size of the structural support member 94 will depend upon the size of the door, materials utilized, and other structural factors as will be known by those skilled in the art. Similarly, the number and size of structural brace members 98** will depend upon such factors.

Still referring to FIG. 1, the door assembly 22 will preferably be provided with a plurality of hinges 108 for mounting the door to a truss 110 or other support member in the opening 28 of the building 20. The number and arrangement of hinges 108 will again depend upon the factors enumerated. Likewise, the upper and lower door sections 32 and 34 will be joined for pivotable movement by either a plurality of hinges or a piano hinge taking into account such factors.

Referring to FIGS. 3 through 6, a rubber astragal 112 is provided to seal the top of the door assembly 22. It will also be seen that a rubber astragal 114 is provided to seal the bottom of the door assembly 22 when the door assembly is in a fully lowered position. With these components, the door assembly 22 is rendered weathertight when in a fully lowered position and the hinges 108 are protected from exposure to the elements.

Referring to FIG. 7, an alternative structural support member 94' is illustrated. It will be seen that the structural support member 94' comprises a Z-shaped member having an upwardly projecting flange **94*a'* and a downwardly projecting flange 94*b'* joined by a solid web portion 94*c'*, and the structural support member 94' can be utilized, if desired, in place of the structural support member 94. As shown, the upwardly projecting flange 94*a'* is secured to the rectangular frame 44 and the downwardly projecting flange 94*b'* is secured to the sheeting material 48 (see, also, FIG. 10**).

Referring to FIGS. 8 and 9, the latch assembly 60 operates in a most effective manner. It will be seen that a mounting plate 116 is secured to the rectangular frame 46 and includes a frame 118 within which the latch member 62 is pivotally mounted by means of a pin as at 66 and the spring 64 extends from a hole 120 in the latch member 62 intermediate its ends to a point of securement on the mounting plate 116 as at 122. Moreover, the stop 70 is integrally secured to the mounting plate 116 as by welding or the like.

Also as shown, the lift cable 72 is attached to the latch member 62 as at 124. The lift cable 72 then extends through a pair of pivotally mounted pulley assemblies 126 and 128 and then extends upwardly to a door opening mechanism (not shown). Finally, the catch plate 68 is secured to the inwardly facing surface 130 of the door track 40 as by welding.

Referring to FIG. 11, it will be appreciated that the building 20 is well suited for use as an aircraft hanger having a plurality of individual bays 132 for storing aircraft and may also include an office complex 134 at one end thereof. Moreover, the building 20 has such considerable versitility as to be well adapted for a variety of purposes including storage of large equipment such as farm machinery, earth moving equipment, large trucks and the like.

With the present invention, the problem of snow and ice accumulation at the base of a door has been significantly alleviated. The mansard shape makes it far less likely for snow and ice to build up at the base of the door in a manner restricting the opening action for making it necessary for snow removal to eliminate frozen door problems. Moreover, even where there is frequent thawing and freezing, ice is far less likely to build up at the bottom of the door to cause the door to stick in the down position.

Since there is less likelihood of a build up of snow and ice, the drivers of snow plows at airports and the like are far less likely to damage the doors during snow removal operations. Also, even though the building does not have gutters and down spouts, the design effectively keeps water from passing under the door by directing it away from the building. Moreover, because of the overhang of the upper door section, the weight of the door applies a downwardly and inwardly directed force designed to assure that the door fully closes when lowered.

With the present invention the building and bi-fold door assembly have a distinctive appearance. It is possible, for instance, to accomplish much in the sense of architectural design by painting the top and bottom portions of the building and door different colors, utilizing different materials, and it is even possible to utilize different shapes other than that suggested by the flat surfaces illustrated herein in connection with the upper and lower sections of the door and wall. In other words, the top and bottom portions need not each have a single slope.

Still further advantages in the present invention include the fact that the design of the frame is successful in increasing wind resistance. The "overhang" of the upper door section also renders the door assembly self-closing and assures that it will remain in a closed position since there is a force component urging the rectangular frame members against the door track in the lowered position of the door assembly. Moreover, the overall frame concept stiffens the door assembly in a raised position and permits the use of thin, flat sheeting to reduce overall construction expense.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

We claim:

1. A bi-fold door assembly movable between raised and lowered positions for mounting in a building, comprising:

an upper door section hinged to a lower door section, said door sections having front surfaces adapted to face outwardly of said building, said door sections having rear surfaces adapted to face inwardly of said building;

said outwardly facing front surface of said upper door section being disposed in a plane intersecting a plane defined by said outwardly facing front surface of said lower door section in said lowered position of said door assembly, the plane defined by said outwardly facing front surface of said lower door section being a vertical plane and a top of said upper door section being disposed in said vertical plane in said lowered position of said door assembly, said outwardly facing front surface of said upper door section being sloped downwardly and outwardly of the top thereof to an overlying position defining an overhang relative to said outwardly facing front surface of said lower door section in said lowered position of said door assembly, and a frame portion horizontally disposed between the front and rear surfaces of said upper door section and being secured thereto for supporting said front surface in the sloped position.

2. The bi-fold door assembly as defined by claim 1 including a door track adapted to be mounted adjacent said inwardly facing rear surface of said lower door section and inwardly of said inwardly facing rear surface of said upper door section.

3. The bi-fold door assembly as defined by claim 2 including means associated with a bottom of said lower door section adapted to cooperate with said door track.

4. The bi-fold door assembly as defined by claim 3 wherein said means adapted to cooperate with said door track comprises a guide roller and a column follower, said guide roller and said column follower engaging said door track for movement therealong, said guide roller and said column follower being mounted at the bottom of said lower door section.

5. The bi-fold door assembly as defined by claim 2 wherein said door track is formed of steel angle having an outwardly facing front surface adapted to confront said inwardly facing rear surface of said lower door section, and including means associated with a bottom of said lower door section adapted to cooperate with said outwardly facing front surface of said steel angle.

6. The bi-fold door assembly as defined by claim 5 wherein said door track includes a straight section formed of steel angle adapted to be mounted adjacent opposing ends of said upper and lower door sections, said steel angles each having an outwardly facing surface adapted to confront said inwardly facing rear surface of said lower door section.

7. The bi-fold door assembly as defined by claim 2 wherein the top of said upper door section is adapted to be hinged for pivotable movement above a top of said door track, said upper door section being adapted for pivotable movement in a direction opposite a direction of pivotable movement of said lower door section.

8. The bi-fold door assembly of claim 7 wherein the top of said upper door section and a bottom of said lower door section always remain in the plane defined by said door track, a plane defined by said door track being a generally vertical plane, said generally vertical plane defined by said door track being parallel to the plane defined by said outwardly facing front surface of said lower door section.

9. The bi-fold door assembly as defined by claim 1 including an independent frame assembly associated with each of said upper and lower door sections, said frame assembly associated with said upper door section being hinged to said frame assembly associated with said lower door section, said independent frame assembly associated with each of said upper and lower door sections being covered with a sheeting material.

10. The bi-fold door assembly as defined by claim 9 wherein said independent frame assembly associated with said upper door section includes a rectangular frame disposed in a vertical plane and said horizontally disposed frame portion projects outwardly of said rectangular frame at a bottom thereof.

11. The bi-fold door assembly as defined by claim 10 wherein said sheeting material covering said upper door section extends from a top of said rectangular frame to an outermost point of said outwardly projecting frame portion, said sheeting material covering said upper door section comprising said outwardly facing front surface sloped downwardly and outwardly to said overlying position defining said overhang relative to said lower door section.

12. The bi-fold door assembly as defined by claim 11 including a structural support member projecting outwardly of said rectangular frame intermediate a top and bottom thereof, said structural support member extending between said rectangular frame and said sheeting material, said structural support member being provided to stiffen said sheeting material intermediate a top and bottom thereof.

13. The bi-fold door assembly as defined by claim 11 wherein said outwardly projecting frame portion of said rectangular frame is a horizontally disposed Z-shaped member, said Z-shaped member being disposed perpendicular to said rectangular frame, said sheeting material being secured to said rectangular frame and said horizontally disposed Z-shaped member.

14. The bi-fold door assembly as defined by claim 13 wherein said Z-shaped member is secured to said rectangular frame at a bottom thereof, said Z-shaped member including an upwardly projecting flange adapted to be secured to one of said sheeting material and rectangular frame and a downwardly projecting flange adapted to be secured to the other of said sheeting material and rectangular frame, said Z-shaped member including a solid web portion joining said flanges thereof.

15. The bi-fold door assembly as defined by claim 10 wherein said frame portion projecting outwardly of said rectangular frame is a horizontally disposed rectangular truss, said rectangular truss being disposed perpendicular to said rectangular frame, said sheeting material being secured to said rectangular frame and said horizontally disposed rectangular truss.

16. The bi-fold door assembly as defined by claim 15 including a structural brace member extending from an outermost point of said rectangular truss to a point intermediate a top and bottom of said rectangular frame, said structural brace member being secured to both said rectangular truss and said rectangular frame in rigid fashion.

17. The bi-fold door assembly as defined by claim 15 including a soffit sheet secured to said rectangular truss, said soffit sheet extending from said sheeting material covering said lower door section to said sheeting material covering said upper door section, said soffit sheet being disposed in a generally horizontal plane.

18. The bi-door assembly as defined by claim 11 including a pair of door end caps associated with each of said upper and lower door sections, said end caps associated with said upper door section extending from the top of said rectangular frame to the outermost point of said frame portion and including a first flange overlapping said sheeting material thereon and a second flange perpendicular to said first flange and projecting inwardly thereof, said end caps associated with said lower door section extending from a top of said frame assembly to a lowermost point of said frame assembly and including a first flange overlapping said sheeting material thereon and a second flange perpendicular to said first flange and projecting inwardly thereof, said end caps being generally L-shaped in configuration.

19. The bi-fold door assembly as defined by claim 4 including a latch assembly associated with said lower door section, said latch assembly including a spring biased latch member mounted for pivotal movement on said lower door section and a catch plate mounted on said door track, said latch member being adapted to engage said catch plate to lock said door assembly in said lowered position.

20. The bi-door assembly as defined by claim 19 wherein said latch assembly includes a stop member to limit pivotal movement of said latch member, and including means for pivotally moving said latch member into contact with said stop member, and latch member being disengaged from said catch plate when in contact with said stop member to permit movement of said door assembly to said raised position.

21. The bi-fold door assembly as defined by claim 20 wherein said means for pivotally moving said latch member includes a lift cable, said lift cable being adapted to disengage said latch member from said catch plate against a biasing force of said spring on said latch member when said lift cable is subjected to a lifting force, said lift cable moving said door assembly to said raised position therafter.

22. A building, comprising:

an upper wall portion and a lower wall portion, said wall portions having front surfaces adapted to face outwardly of said building, said wall portions having an opening for a door assembly therein;

said outwardly facing front surface of said upper wall portion being disposed in a plane intersecting a plane defined by said outwardly facing front surface of said lower wall portion, the plane defined by said outwardly facing front surface of said lower wall portion being a vertical plane and a top of said upper wall portion being disposed in said vertical plane, said outwardly facing front surface of said upper wall portion being sloped downwardly and outwardly of the top thereof to an overlying position defining an overhang relative to said outwardly facing front surface of said lower wall portion; and a bi-fold door assembly movable between raised and lowered positions mounted within said opening in said wall portions and including an upper door section and a lower door section;

said upper door section being hinged to said lower door section, said door sections having front surfaces facing outwardly of said building, said door sections having rear surfaces facing inwardly of said building;

said outwardly facing front surface of said upper door section being disposed in a plane intersecting a plane defined by said outwardly facing front surface of said lower door section in said lowered position of said door assembly, the plane defined by said outwardly facing front surface of said lower door section being a vertical plane and a top of said upper door section being disposed in said vertical plane in said lowered position of said door assembly, said outwardly facing front surface of said upper door section being sloped downwardly and outwardly of the top thereof to an overlying position defining an overhang relative to said outwardly facing front surface of said lower door section in said lowered position of said door assembly, a frame portion horizontally disposed between the front and rear surfaces of said upper door section and being secured thereto for supporting said front surface in the sloped position;

said upper wall portion and upper door section being coplanar in said lowered position of said door assembly and said lower wall portion and lower door section being coplanar in said lowered position of said door assembly.

23. The building as defined by claim 22 including an independent frame assembly associated with each of said upper and lower door sections, said frame assembly associated with said upper door section being hinged to said frame assembly associated with said lower door section, said independent frame assembly associated with each of said upper and lower door sections being covered with a sheeting material.

24. The building as defined by claim 23 wherein said independent frame assembly associated with said upper door section includes a rectangular frame disposed in a vertical plane and said horizontally disposed frame portion projects outwardly of said rectangular frame at a bottom thereof.

25. The building as defined by claim 24 wherein said sheeting material covering said upper door section extends from a top of said rectangular frame to an outermost point of said outwardly projecting frame portion, said sheeting material covering said upper door section comprising said outwardly facing front surface sloped downwardly and outwardly to said overlying position defining said overhang relative to said lower door section.

26. The building as defined by claim 25 including a soffit sheet secured to said outwardly projecting frame portion, said soffit sheet extending from said sheeting material covering said lower door section to said sheeting material covering said upper door section, said soffit sheet being disposed in a horizontal plane.

27. The building as defined by claim 26 including a pair of door end caps associated with each of said upper and lower door sections, said end caps associated with said upper door section extending from the top of said rectangular frame to the outermost point of said frame portion and including a first flange overlapping said sheeting material thereon and a second flange perpendicular to said first flange and projecting inwardly thereof, said end caps associated with said lower door sections extending from a top of said frame assembly to a lowermost point of said frame assembly and including a first flange overlapping said sheeting material thereon and a second flange perpendicular to said first flange and projecting inwardly thereof, said end caps being L-shaped in configuration.

28. The building as defined by claim 22 including a soffit sheet extending from said outwardly facing front surface of said upper wall portion to said outwardly facing front surface of said lower wall portion in a horizontal plane.

29. A bi-fold door assembly movable between raised and lowered positions for mounting in a building, comprising:

an upper door section hinged to a lower door section, said door sections having front surfaces adapted to face outwardly of said building, said door sections having rear surfaces adapted to face inwardly of said building;

said outwardly facing front surface of said upper door section being disposed in a plane intersecting a plane defined by said outwardly facing front surface of said lower door section in said lowered position of said door assembly, the plane defined by said outwardly facing front surface of said lower door section being a vertical plane and a top of said upper door section being disposed in said vertical plane in said lowered position of said door assembly, said outwardly facing front surface of said upper door section being sloped downwardly and outwardly of the top thereof to an overlying position defining an overhang relative to said outwardly facing front surface of said lower door section in said lowered position of said door assembly, a frame portion horizontally disposed between the front and rear surfaces of said upper door section and being secured thereto for supporting said front surface in the sloped position;

a door track adapted to be mounted adjacent said inwardly facing rear surface of said lower door section and inwardly of said inwardly facing rear surface of said upper door section;

means associated with a bottom of said lower door section adapted to cooperate with said door track;

the top of said upper door section being adapted to be hinged for pivotal movement above a top of said door track, said upper door section being adapted for pivotable movement in a direction opposite a direction of pivotable movement of said lower door section;

the top of said upper door section and the bottom of said lower door section always remaining in a plane defined by said door track, the plane defined by said door track being a vertical plane, said vertical plane defined by said door track being parallel to the plane defined by said outwardly facing front surface of said lower door section; and an independent frame assembly associated with each of said upper and lower door sections, said frame assembly associated with said upper door section being hinged to said frame assembly associated with said lower door section, said independent frame assembly associated with each of said upper and lower door sections being covered with a sheeting material.

30. The bi-fold door assembly as defined by claim 29 wherein said door track includes a straight section formed of steel angle adapted to be mounted adjacent each of opposing ends of said upper and lower door sections, said steel angles each having an outwardly facing front surface adapted to confront said inwardly facing rear surface of said lower door section.

31. The bi-fold door assembly as defined by claim 30 wherein said means adapted to cooperate with said door track comprises a guide roller and a column follower, said guide roller and said column follower engaging said door track for movement therealong, said guide roller and said column follower being mounted at the bottom of said lower door section.

32. The bi-fold door assembly as defined by claim 31 wherein said independent frame assembly associated with said upper door section includes a rectangular frame disposed in a vertical plane and said horizontally disposed frame portion projects outwardly of said rectangular frame at a bottom thereof.

33. The bi-fold door assembly as defined by claim 32 wherein said sheeting material covering said upper door section extends from a top of said rectangular frame to an outermost point of said outwardly projecting frame portion, said sheeting material covering said upper door section comprising said outwardly facing front surface sloped downwardly and outwardly to said overlying position defining said overhang relative to said lower door section.

34. The bi-fold door assembly as defined by claim 33 including a structural support member projecting outwardly of said rectangular frame intermediate the top and bottom thereof, said structural support member extending between said rectangular frame and said sheeting material, said structural support member being provided to stiffen said sheeting material intermediate a top and bottom thereof.

35. The bi-fold door assembly as defined by claim 34 including a soffit sheet secured to said outwardly projecting frame portion, said soffit sheet extending from said sheeting material covering said lower door section to said sheeting material covering said upper door section, said soffit sheet being disposed in a horizontal plane.

36. The bi-fold door assembly as defined by claim 35 including a latch assembly associated with said lower door section, said latch assembly including a spring biased latch member mounted for pivotal movement on said lower door section and a catch plate mounted on said door track, said latch member being adapted to engage said catch plate to lock said door assembly in said lowered position.

37. The bi-fold door assembly as defined by claim 36 wherein said latch assembly includes a stop member to limit pivotal movement of said latch member, and including means for pivotally moving said latch member into contact with said stop member, said latch member being disengaged from said catch plate when in contact with said stop member to permit movement of said door assembly to said raised position.

38. The bi-fold door assembly as defined by claim 37 wherein said means for pivotally moving said latch member includes a lift cable, said lift cable being adapted to disengage said latch member from said catch plate against the biasing force of said spring on said latch member when said lift cable is subjected to a lifting force, said lift cable moving said door assembly to said raised position thereafter.

* * * * *